United States Patent [19]

Atlas

[11] Patent Number: 4,814,131

[45] Date of Patent: Mar. 21, 1989

[54] PROCESS FOR PRODUCING A SHAPED ARTICLE, SUCH AS FIBER COMPOSED OF A HYDROPHOBIC POLYMER AND A HYDROPHILIC POLYMER

[76] Inventor: Sheldon M. Atlas, 211 Central Park West, New York, N.Y. 10024

[21] Appl. No.: 69,237

[22] Filed: Jul. 2, 1987

[51] Int. Cl.[4] ..... B29C 47/06; B29C 55/02; B29C 65/52

[52] U.S. Cl. ..... 264/147; 264/129; 264/171; 264/288.4; 264/DIG. 47; 425/133.5; 425/289

[58] Field of Search ..... 264/147, 171, DIG. 47, 264/129, 288.4; 425/133.5, 289

[56] References Cited

U.S. PATENT DOCUMENTS

| | | | |
|---|---|---|---|
| 3,323,978 | 6/1967 | Rasmussen | 264/DIG. 47 |
| 3,511,742 | 5/1970 | Rasmussen . | |
| 3,539,663 | 11/1970 | Pietrusza . | |
| 3,639,573 | 2/1972 | Port | 264/147 X |
| 3,695,025 | 10/1972 | Gibbon | 57/140 R |

FOREIGN PATENT DOCUMENTS

| | | | |
|---|---|---|---|
| 3323109 | 1/1985 | Fed. Rep. of Germany | 264/147 |
| 134962 | 4/1979 | German Democratic Rep. | 264/147 |
| 49-23252 | 6/1974 | Japan | 264/147 |
| 61-113810 | 5/1986 | Japan | 264/147 |
| 821546 | 4/1981 | U.S.S.R. | 264/147 |
| 1104694 | 4/1968 | United Kingdom . | |
| 1165934 | 10/1969 | United Kingdom . | |
| 1207733 | 10/1970 | United Kingdom . | |
| 1230991 | 5/1971 | United Kingdom . | |
| 1232282 | 5/1971 | United Kingdom . | |
| 1242346 | 8/1971 | United Kingdom . | |
| 1248512 | 8/1971 | United Kingdom . | |
| 1260837 | 1/1972 | United Kingdom . | |
| 1260957 | 1/1972 | United Kingdom . | |
| 1308998 | 3/1973 | United Kingdom . | |

OTHER PUBLICATIONS

*Encyclopedia of Polymer Science and Technology*, vol. 9, New York, Interscience Publishers, a Div. of John Wiley & Sons, Inc., ©1968, pp. 181–184.

*Primary Examiner*—Philip Anderson
*Attorney, Agent, or Firm*—Sherman & Shalloway

[57] ABSTRACT

Normally "dry" or hydrophobic polymers, such as polyolefins, polyesters and the like are rendered more moisture absorptive to improve "breathability" by providing an adherent surface of a hydrophilic polymer. Composite fibers are obtained by stretching a laminated or coated structure of a hydrophobic polymer film and a hydrophilic polymer film, longitudinally dividing the stretched film into a plurality of strips and fibrillating the stretched strips. Alternatively, the film can first be subdivided into the plurality of longitudinal strips and then stretched and fibrillated. In the resulting shaped articles (e.g. fibers), a discontinuous, discrete, adherent covering of the hydrophilic polymer component is provided on a core or substrate composed of the hydrophobic polymer. For example, the moisture regain of high density polyethylene fibers can be increased to more than 1%.

16 Claims, 1 Drawing Sheet

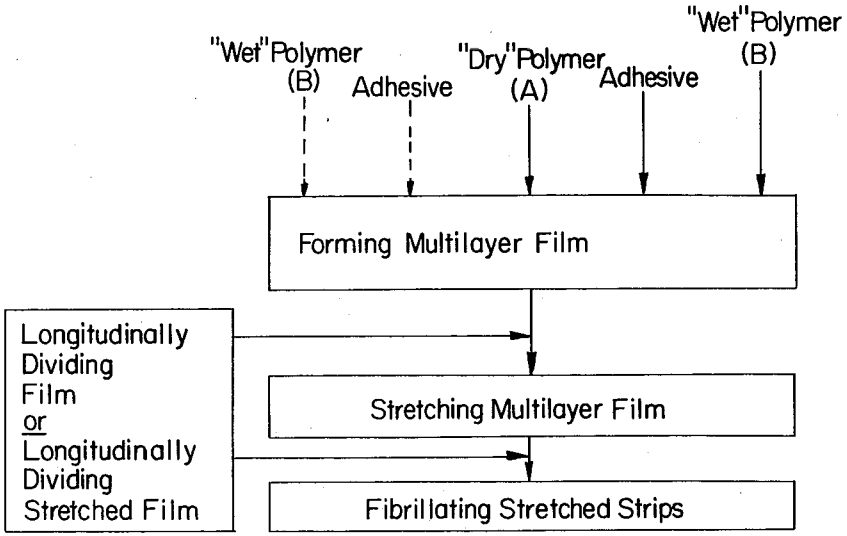
"Wet" Polymer (B)
Adhesive
"Dry" Polymer (A)
Adhesive
"Wet" Polymer (B)
Forming Multilayer Film
Longitudinally Dividing Film or Longitudinally Dividing Stretched Film
Stretching Multilayer Film
Fibrillating Stretched Strips

PROCESS FOR PRODUCING A SHAPED ARTICLE, SUCH AS FIBER COMPOSED OF A HYDROPHOBIC POLYMER AND A HYDROPHILIC POLYMER

BACKGROUND OF THE INVENTION

1. Field of the Invention

This invention relates to the production of composite shaped articles having a hydrophobic component and a hydrophilic component. More particularly, this invention relates to a process for producing fibers, filaments, yarns, films and other shaped articles in which the beneficial characteristics of both components, such as strength and moisture absorptivity (moisture regain), are combined.

2. Discussion of the Prior Art

It is known in the art to blend natural moisture absorbent or breathable types of natural and modified fibers, such as cotton, wool and rayon, to "comfortize" textile goods made from "dry" fiber types, such as the synthetic polyesters, polyolefins, polyamides and the like, to improve wear and feel characteristics.

It is also known to form shaped articles from blends of two or more polymers to obtain products combining the properties of both polymers or to achieve specific properties and effects. However, it is difficult to form such products from polymers having greatly disparate physical properties in view of the tendency of the polymer blends and resulting articles to separate into different phases.

U.S. Pat. No. 3,323,978 to Ole-Bendt Rasmussen discloses artificial textile fibers prepared by film to fiber technology from a blend of hydrophobic (major component) polymer and hydrophilic (minor component) polymer. As described in this patent the fibrous product has a two-phase structure including a continuous core portion of an oriented, normally crystalline, predominantly hydrophobic polymer, and a discontinuous surface portion of a different distinctly hydrophilic polymer. According to this patent a blend of the two polymers (or a potentially hydrophilic form of the hydrophilic polymer) is formed into a film. The film is stretched to orient uniaxially the crystalline hydrophobic polymer component. The stretched film is then contacted with a swelling agent for the hydrophilic polymer and the film is then split into a fibrous article having the two-phase structure described above. This process is dependent on the orientation forming a fibrillar two-phase microstructure of the hydrophobic and hydrophilic components, with the subsequent swelling treatment weakening the hydrophilic fibrils so that the splitting process will mainly be in the hydrophilic substance whereby the resulting fibers will have an accumulation of hydrophilic polymer at the surfaces. However, it has been found by subsequent follow-up work of this technique that the use of a swelling agent is detrimental in that, although facilitating longitudinal splitting and fibrillation, it also increases the tendency for crack formation.

Another drawback of the composite fibers produced from the polymer blends as disclosed by Rasmussen is that in view of the widely different molecular structures of the hydrophobic polymer and the hydrophilic polymer the resulting composite fibers show a pronounced tendency to separate at the interface between the hydrophobic and hydrophilic polymers upon repeated bending or flexing.

Accordingly, it is an object of this invention to provide an improved process for forming composite fibers from hydrophobic and hydrophilic polymer whereby the moisture regain properties of the composite fiber is substantially higher than that of the hydrophobic polymer.

It is another object of the invention to provide such a process wherein the resulting composite fibers have improved mechanical properties and stability in addition to high moisture regain.

Still another object of the invention is to provide composite fibers composed predominantly of a hydrophobic polymer with a discrete surface layer of a hydrophilic polymer and which is able to withstand repeated bending or flexing without undergoing separation of the polymer components.

Still yet another object of the invention is to provide a process which forms a composite hydrophobic polymerhydrophilic polymer fiber using the film-to-fiber technology but without requiring use of a swelling agent.

The above and other objects of the present invention have been accomplished based on the discovery that a similarly structured hydrophobic-hydrophilic two-phase composite fiber structure can be obtained without the use of any swelling treatment by stretching a laminated or coated film composed of a layer of hydrophobic polymer and a layer or layers of hydrophilic polymer and directly fibrillating the stretched laminate.

It has further been discovered that by providing a very thin layer of a compatible adhesive binder between the layer of hydrophobic polymer and the layer or layers of hydrophilic polymer the tendency of the different polymer components to separate upon repeated bending or flexing is substantially reduced or eliminated. Furthermore, it has been found that the presence of the thin binder layer does not interfere with the longitudinal splitting or fibrillation steps of the film-to-fiber procedure.

The present invention, therefore, provides a process for producing new types of fibers, as well as filaments, films and other shaped articles, in which a hydrophilic polymer component is intimately and stably associated with the surface of a hydrophobic polymer component so as to provide a wider range of properties than possible merely by blending equivalent amounts of the two polymer components.

SUMMARY OF THE INVENTION

According to the process of the invention, composite, stable shaped articles, particularly fibers, are produced by forming a laminate or coating of a film of a hydrophobic polymer component (A) and on one or both sides of the film of the component (A) a film or coating of a hydrophilic polymer component (B) at a thickness ratio of film A to film B (total thickness) of from about 99:1 to about 1.5:1; stretching the laminate to a draw ratio of at least 3, either before or after stretching, longitudinally dividing the laminate into a plurality of strips, and thereafter subjecting the stretched strips to fibrillation to obtain a plurality of texturized fibrous structures. In these fibrous structures, the hydrophobic A-polymer is present as a continuous, or at least substantially continuous, substrate fiber and the hydrophilic B-polymer is present as a discrete, but discontinuous, adherent "coating" on the surface of the hydrophobic polymer fiber.

According to the preferred embodiment of this invention, in the above described process, a thin layer of a compatible adhesive binder layer is provided between the film of hydrophobic polymer A and the film or coating of hydrophilic polymer B, this compatabilizing adhesive layer function to inhibit microseparation of the A and B polymer components of the resulting composite fiber by establishing a firm and lasting contact between the two polymer components.

BRIEF DESCRIPTION OF THE DRAWING FIGURE

The accompanying FIGURE is a flow sheet illustrating the steps of an embodiment of the process of this invention.

DETAILED DESCRIPTION AND PREFERRED EMBODIMENTS

Thus, a stable polyblend of two macromolecular species is formed into a shaped article, such as a fiber or filament. The major component, A, of the polyblend is a linear high melting, crystalline hydrophobic polymer which, as a film or fiber, is characterized by high values of tensile modulus, strength-dry and wet, elongation to break and resilience, but has low moisture regain, i.e. less than about 3.5%. The other minor component, B, of the polyblend is a linear non-crystalline hydrophilic polymer which, as a film or fiber, has moderate values of tensile modulus, but high moisture absorbency, namely a moisture regain of at least 4%. The moisture regain of the shaped article is greater than the moisture regain of hydrophobic polymer. The two components are blended in the fiber to a three dimensional entanglement of serpentine segments which prevents their separation by thermal, mechanical or solvent action. The mechanical strength and stability against polymer phase separation is enhanced by providing a thin layer of a compatible adhesive binder between the layer of polymer A and the layer(s) of polymer B.

Thus, using only relatively small amounts of the "wet" B-polymers, fibers with the advantageous strength, tensile modulus, elongation to break and resilience of the "dry" A-polymers, but with improved moisture regain, attributable to the "wet" B-polymer present at the surface A-polymer fiber substrate, are obtained.

Polymer A is the predominant component of the polyblend amounting to at least 60, preferably 70 to 95, especially preferably 75 to 90, parts of the blend. Polymer A is characterized by being capable of being oriented by "cold drawing" to 4 to 16 times, preferably 8 to 12 times, of its original length, after which deformation, it forms axially oriented microfibrils which consist of a system of folded chain crystallites molded together with fully extended tie molecules. Examples of polymers satisfying this characteristic include, for example, linear polyamides having a melting point above 220° C.; linear polyester with a melting point above 220° C., such as polyethylene terephthalate, polytetramethylene terephthalate, etc.; polyolefins, such as high density polyethylene (HDPE) having a melting point of at least about 130° C.; or isotactic polypropylene with a melting point of at least about 170° C. Other suitable, but less preferred examples of polymers which can be used as Polymer A include polyacrylonitriles and other hydrophobic vinyl polymers. In addition to this property, Polymer A is characterized by a moisture regain ranging from about 0.1 to about 3.5; in other words polymer A is a "dry" fiber former. Polymer A should have a viscosity average molecular weight between 20,000 and 50,000, preferably between 30,000 and 40,000.

Polymer B is the minor component and is present in amounts of at most 40, preferably 5 to 30, especially preferably 10 to 25, parts of the polyblend. It must be capable of being oriented but its molecules, although axially parallelized, must not form crystallites. The absence of crystallites, together with the polyblend nature of the resulting fiber allows Polymer B to be selected from among a wide variety of copolymers containing a random mixture of hydrophobic and hydrophilic groups. This offers for this minor part of the polyblend the possibility to have high moisture regains, preferably in the upper part of the range from 30 to 90%. Examples of suitable polymers include nylon-2, polyethylene oxide, polyhydroxyethyl-acrylate and -methacrylate. Examples of suitable copolymers include poly(acrylonitrile/acrylamide); poly(vinylor vinylidene-chloride/vinyl alcohol). It is well understood by persons skilled in the art that there exists a great number of homo-, co- and ter-polymers which fulfill the characteristics specified above and, therefore, could be used to practice this invention.

Generally, the B polymers should have viscosity average molecular weights in the same general range as mentioned for the A polymers, especially above 30,000, such as from 30,000 to 40,000. The B polymers generally also are preferably selected with melting or softening temperatures above about 180° C.

The following Table 1 provides a list of suitable A and B polymers together with values for moisture regain.

TABLE 1

Approximate Moisture Regain of a Few Polymers in Equilibrium with 65% Ambient Water Vapor Content

| Material | Regain in percent |
|---|---|
| "Dry" Fibers (Polymer A) | |
| Polyolefin | less than 0.1 |
| Polyacrylonitrile | around 1–0.5 |
| Polyethylene terephthalate (PET) | 0.5–1.5 |
| nylon-11 - nylon-12 | less than 0.5 |
| nylon-6 and -66 | 3.0–3.5 |
| "Wet" Fibers (Polymer B) | |
| Cotton | 7.5 |
| Rayon | 13.0 |
| Wool | 15.0 |
| Nylon-2 | 15.5 |
| Polyvinyl alcohol | 6–8 |
| Poly(hydroxyethylmethacrylate) (HEMA) | |
| Polyacrylic Acid | |
| Polyethylene oxide | |
| Polyethyleneimine | |

The polyblend fibers are most conveniently prepared using film to fiber technology. The attached FIGURE provides a flow sheet illustrating the steps used in the invention process. In this technique, there is in the first step a film of polymer A laid down on a film casting machine. This may be done by evaporating the solvent of a polymer solution or, preferably, by extruding a polymer melt and solidifying the film by a set of chill rolls.

Then, in the next step, this film is coated or laminated, on one or both sides, with a thin layer of polymer B.

This also may be done from solution or directly by melt coating.

In the preferred embodiment of the invention, it is desirable to increase the adhesion of film B to film A. This is done by providing a very thin (one micron or less) adhesive layer between film A and film B. Usually, it is convenient to deposit the adhesive layer on the surface of the film of dry polymer A to be laminated to the film of wet polymer B. For example, the compatabilizing adhesive binder layer can be coated, e.g. from an organic solvent solution, an aqueous dispersion, etc., on the film of the hydrophobic polymer A and, after removal of the liquid carrier, as by drying or evaporation, a coating, from solution or directly by melt coating, or other extrusion lamination techniques, of hydrophilic polymer B can be laid down on the adhesive binder layer.

The adhesive binder layer, in the final product, namely after stretching or fibrillation, should be very thin, namely less than about 1 micron, for example, 0.05 to 0.8 micron. These dimensions can be achieved by depositing the binder layer in a thickness in the range of about 1 to 5 microns, preferably 2 to 4 microns. Furthermore, the compatabilizing material forming the adhesive binder layer should have a moisture regain between that of polymer A ("dry" polymer) and polymer B ("wet" polymer), generally in the range of about 2 to 6, preferably 3 to 5, especially about 3.5 to 4.0.

As examples of appropriate materials (C) for the compatabilizing agent, mention can be made, for instance, of copolymers of methylmethacrylate and 2-hydroxyethylmethacrylate; copolymers of acrylonitrile and 2-hydroxyethylmethacrylate, ionomer resins, copolymers of acrylic esters, certain types of polyvinyl alcohol, and the like.

It is also possible to increase the adhesion between the hydrophobic and hydrophilic polymers by pretreating the film of hydrophobic polymer with plasma radiation or by oxidative flame action.

The coated or laminated composite film is then converted into stretched and oriented tapes or strips; this can be done in two ways:

1. It is possible to cut the film in tapes before stretching. The polymer film being delivered from an extruder equipped with a circular or flat slit die in the form of a tubular or a flat film is cut into strips of 1 to 20 mm width. The resulting primary tapes are stretched to such an extent as necessary to achieve the desired dimensions and properties.

2. It is also possible to perform the tape cutting after the stretching operation. The polymer film extruded as described is stretched to an extent necessary to achieve the desired thickness dimension and mechanical properties in the final tape before the separation in film-tapes of desired width.

In the practicing of this invention, either of these methods may be used for the production of a composite fiber in the denier range from 2 to 16 in which the two components are permanently and closely attached to each other and where they differ substantially in their moisture regain at a given ambient water vapor pressure.

For more details on the film to fiber technology reference may be had to H. A. Kraessig, J. Lenz, H. Mark, *Fiber Technology—From Film To Fiber,* Marcel Dekker, Inc., New York (1984), the entire disclosure of which is incorporated herein by reference thereto.

EXAMPLE 1

HDPE having a melting point, Tm, of 132° C., a glass transition temperature, Tg, of −25° C., a density of 0.960 and a melt index MI of 2.0 is melt extruded at 240° C. on chill rolls to a flat film having the following properties:

| | |
|---|---|
| width | 150 cm |
| thickness | 50 microns |
| crystallinity (folded chains) | about 55% |
| orientation | about 88% |

This film is put on a roller and kept at 25° C. for 24 hours to relieve and relax stresses. It is then subcoated on one side by a roller coater with a thin (2–4 microns) layer of a copolymer of methylmethacrylate and 2-hydroxyethylmethacrylate (c). After drying, the film is then coated over the copolymer coating with polyacrylic acid (PAAc) dissolved in a mixture of alcohol and water. The PAAc coating has a gauge of 10 microns. After cooling down, drying and relaxing the coated film is put on a roller and rested there for 6 hours.

The resulting film consisting of HDPE layer of 50 microns, the compatible copolymer binder layer of 2 microns and PAAc layer of 5 microns is then put on a drawing machine and stretched to a draw ratio of 6 at 85° C. Although many variations of drawing procedures may be used within the scope of this invention the procedure described on pages 101 and 132 and of 264 to 266 of the above-mentioned book of H. A. Kraessig, et al. has been used with good results.

Owing to the friction of the film with the various rollers there is not much lateral shrinking and the stretched film has a width of 135 cm and a gauge of 6.5 microns. The film is put on a slicing and fibrillation machine, the principles of which are well known and are described in detail on pages 154 to 182 of the aforementioned textbook by Kraessig, Lenz and Mark. The equipment which is used for this step came from the Barmag-Barmer Maschinenfabrik A.G. and is commercially used for the "BARFILEX" process. At the end of the drawing, splicing, fibrillation and twisting steps there results a plurality of texturized filaments of HDPE each carrying a thin coating of polyacrylic acid. Microscopic observation discloses that the coating is not uniform but consists of irregular patches of the hydrophilic component at the surface of the "dry" fiber. The properties of these composite filaments are:

| | |
|---|---|
| Modulus of elasticity | 60 g/dtex |
| Tensile strength | 5.8 g/dtex |
| Elongation at break | 32% |
| Elastic recovery | 89% |
| Moisture regain | 1.6% |
| Tm | 108° C. |
| Tg | −26° C. |

These filaments, alone, or together with other standard fibers, can be used for practically all familiar textile operations, such as weaving, knitting and crochetting.

EXAMPLE 2

The procedure of Example 1 is repeated except that as the "dry" polymer "A" isotactic polypropylene (PP)

having a Tm of 168° C., a glass transition temperature Tg of 30° C., a density of 0.907 and MI of 14 is used and the extrusion temperature is changed to 245° C. to produce a flat film of 150 cm width and 50 micron thickness on which is deposited a thin (2 micron) layer of a commercially available ionomer resin (c).

Furthermore, as the "wet" polymer B poly(hydroxyethylmethacrylate) [poly(HEMA)] dissolved in a mixture of alcohol and water is used to form a coating on the ionomer resin layer, having a gauge of 10 microns.

The coated film consisting of PP layer of about 45 microns, ionomer (2 microns), and a poly(HEMA) layer of 5 microns is then processed under the same conditions as described in Example 1 to obtain a stretched film with a width of 135 cm and a gauge of 6.5 microns. At the end of the drawing, splicing, fibrillation and twisting steps there results a plurality of texturized filaments of PP each carrying a thin coating of poly(-HEMA). Microscopic observation discloses that the coating is not uniform but consists of irregular patches of the hydrophilic component at the surface of the "dry" fiber. The properties of these composite filaments are:

| | |
|---|---|
| Modulus of elasticity | 52 g/dtex |
| Tensile strength | 5.5 g/dtex |
| Elongation at break | 28% |
| Elastic recovery | 92% |
| Moisture regain | 2.0% |
| Tm | 168° C. |
| Tg | −30° C. |

EXAMPLE 3

The procedure of Example 1 is followed using nylon 66 having a Tm of 265° C. and a glass transition temperature Tg of 57° C., a density 1.16 and a MI of 14 (extruded at 250° C.) as the dry polymer component A, and polyvinyl alcohol (degree of hydrolysis about 35%) as the compatibilizing adhesive binder (c), and polyvinyl alcohol (degree of hydrolysis above 55%) as the wet polymer B. The polyvinyl alcohol is deposited from its solution in a mixture of ethyl alcohol and water.

The coated film consisting of a nylon 6,6 layer of 50 microns, polyvinyl alcohol binder layer of 2 microns and polyvinyl alcohol layer of 5 microns is then put on a drawing machine and stretched to a draw ratio of 7 at 90° C. The same drawing procedures are followed as in Examples 1 and 2.

The stretched film has a width of 135 cm and a gauge of 6.5 microns. After the drawing, slicing, fibrillation and twisting steps there results a plurality of texturized filaments of nylon 6,6 each carrying a thin coating of polyvinyl alcohol. Microscopic observation discloses that the coating is not uniform but consists of irregular patches of the hydrophilic component at the surface of the "dry" fiber. The properties of these composite filaments are:

| | |
|---|---|
| Modulus of elasticity | 54 g/dtex |
| Tensile strength | 5.4 g/dtex |
| Elongation at break | 38% |
| Elastic recovery | 94% |
| Moisture regain | 2.5% |
| Tm | 240° C. |
| Tg | 75° C. |

EXAMPLE 4

The procedures of the preceding examples are repeated using polyethylene terephthalate (PET) polyester having a Tm of 250° C., a glass transition temperature Tg of 77° C., a density of 1.32 and a MI of 12 (extruded at 280° C.) as the A polymer, a copolymer of acrylonitrile and 2-hydroxyethylmethacrylate, as the binder (c), and polyethylene oxide (dissolved in a mixture of alcohol and water) as the B polymer to obtain a coated film consisting of the polyester layer of 50 microns, the binder layer (2 microns) and the polyethylene oxide layer of 5 microns. The same drawing procedures were followed as in Examples 1 and 2 to obtain a stretched film having width of 135 cm and a gauge of 6.5 microns. At the end of the drawing, slicing, fibrillation and twisting steps, as previously described, there results a plurality of texturized filaments of PET which carry a thin coating of polyethyleneoxide. Microscopic observation discloses that the coating is not uniform but consists of irregular patches of the hydrophilic component at the surface of the "dry" fiber. The properties of these composite filaments are:

| | |
|---|---|
| Modulus of elasticity | 65 g/dtex |
| Tensile strength | 6.0 g/dtex |
| Elongation at break | 35% |
| Elastic recovery | 94% |
| Moisture regain | 1.7% |
| Tm | 248° C. |
| Tg | 80° C. |

Each of the composite fibers of Examples 1–4 can be subjected to several hundred repeated cycles of bending or flexing without microseparation of the hydrophobic and hydrophilic polymers.

In accordance with the present invention, any of these composite fibers may be assembled or fabricated into various types of fabrics including those involving interlocked yarns or threads formed of plied yarns and those of felt-like character in which the fibers or filaments are interlaced or interlocked with or without being adhesively bonded at their points of intersection or interlocking. The former type of fabric may be a woven, knitted, netted, knotted, or braided fabric formed of yarns comprising fibers or filaments of the type specified. Non-woven fabrics are also obtainable by the haphazard distribution of a multiplicity of fibers either of short lengths or of continuous length. This includes such fabrics as are obtained by carding, and if desired, superimposing a plurality of carded webs upon one another with the machine direction of the various webs disposed either parallel to one another or at various angles for the purpose of providing either anisotropy or isotropy in the characteristics of the resulting fabric, particularly as to strength and cleavage. Intermediate forms, which may also be termed hybrid forms, of fabrics may be involved such as the type of fabric known as needle felts wherein a woven or knitted fabric has fibers or filaments punched through the woven base fabric.

The various fabrics may be formed entirely of fibers, filaments, and yarns of the type defined above, or they comprise a blend of fibers or filaments of this type with fibers or filaments of other types, either natural or artificial in origin. Similarly, the fabrics may be formed of a mixture of yarns comprising fibers or filaments of the type defined above with yarns formed of other fibers, either natural or artificial. Thus, the fabrics may also comprise fibers, filaments, or yarns of cotton, wool, silk, linen, nylon, polyethylene terephthalate (e.g. Dacron), regenerated cellulose rayons, cellulose acetate, casein, vinyl resin fibers, such as copolymers of vinyl chloride and vinyl acetate or acrylonitrile, and especially polyesters, polyacrylonitriles, and polyamides. The proportion of fibers, filaments, or yarns formed of the composite fibers of this invention in the fabrics may vary widely from 1 to 100%.

The filaments, fibers or yarns and fabrics formed thereof may be subject to other customary finishing processes, such as crimping, curling, twisting, sizing, softening, or lubricating to facilitate weaving, knitting and other textile operations.

For example, fabrics prepared from the composite fibers of the invention are suitable in such application as articles of apparel, bedding, industrial fabrics and the like.

What is claimed is:

1. A process for preparing a composite shaped article composed of a substrate of a substantially hydrophobic crystalline, linear polymer (A) and intimately associated therewith a non-uniform, discrete, discontinuous covering of a non-crystalline hydrophilic linear polymer (B), said hydrophobic polymer having a moisture regain, under standard conditions, of less than about 3.5%, said hydrophilic polymer having a moisture regain, under standard conditions, of at least about 4.0%, and said shaped body having a moisture regain greater than the moisture regain of said hydrophobic polymer, said process comprising forming a multilayer film of a film of said hydrophobic polymer (A) and on one or both sides of the film of polmyer (A) a layer of hydrophilic polymer (B) at a thickness ratio of film (A) to film (B) of from about 99:1 to about 1.5:1, and interposed between the film of hydrophobic polymer (A) and the layer of hydrophilic polymer (B) an adhesive layer of a compatible binder material, said material having a moisture regain between the moisture regain of the hydrophobic polymer and the moisture regain of the hydrophilic polymer; stretching the multilayer film to a draw ratio of at least 3, either before of after stretching, longitudinally dividing the multilayer film into a plurality of strips, and subjecting the stretched strips to fibrillation to obtain said composite shaped article.

2. The process of claim 1 wherein said shaped article is in the form of fiber, filament or ayrn.

3. The process of claim 1 wherein said hydropohobic polymer is a linear polyester, linear polyamide, or polyolefin and the hydrophilic polymer is a polyamide, poly(ethylene oxide), poly(hydroxyethyl methacrylate), poly(hydroxyethyl acrylate), copolymer of acrylonitrile and acrylamide or methacrylamide, or copolymer of vinyl- or vinylidene-chloride and vinyl alcohol.

4. The process of claim 1 wherein the hydrophobic polymer and the hydrophilic polymer have viscosity average molecular weights in the range of 20,000 to 50,000.

5. The process of claim 1 wherein said multilayer film comprises at least 60% by weight of the hydrophobic polymer and at most 40% by weight of the hydrophilic polymer.

6. The process of claim 1 wherein said multilayer film comprises from 70 to 95% by weight of the hydrophobic polymer and from 5 to 30% by weight of the hydrophilic polymer.

7. The process of claim 1 wherein from about 20 to about 40% of the surface of the hydrophobic polymer substrate is covered by said hydrophilic polymer.

8. The process of claim 1 wherein said covering of said hydrophilic polymer has a thickness in the range of from about 0.01 to about 5 microns.

9. The process of claim 1 wherein the thickness ratio between the hydrophobic polymer film and the hydrophilic polymer layer is in the range of from about 30:1 to about 2:1.

10. The process of claim 1 wherein the multilayer film is first stretched and then longitudinally divided into a plurality of strips.

11. The process of claim 1 wherein said multilayer film is first divided into a plurality of strips and is then stretched.

12. The process of claim 1 wherein the multilayer film is divided into a plurality of strips of about 1 to 20 millimeters in width.

13. The process of claim 1 wherein the adhesive layer is provided with a thickness of from about 2 microns to about 4 microns.

14. The process of claim 1 wherein the compatible binder material is selected from the group consisting of copolymers of methylmethacrylate and 2-hydroxyethylmethacrylate, copolymers of acrylonitrile and 2-hydroxyethylmethacrylate, ionomer resins, and polyvinyl alcohol.

15. The process of claim 1 wherein the multilayer film comprises a film of said hydrophobic polymer and a coating layer of said hydrophilic polymer.

16. The process of claim 1 wherein the multilayer film comprises a laminate of said hydrophobic polymer film and a film layer of the hydrophilic polymer on one or both surfaces of the hydrophobic polymer film.

* * * * *